US011117244B2

(12) United States Patent
Sun et al.

(10) Patent No.: US 11,117,244 B2
(45) Date of Patent: Sep. 14, 2021

(54) RATCHET WRENCH

(71) Applicant: Chih-Chi Chen, Taichung (TW)

(72) Inventors: Kuo-She Sun, Taichung (TW); Chih-Chi Chen, Taichung (TW)

(73) Assignee: Chih-Chi Chen, Taichung (TW)

( * ) Notice: Subject to any disclaimer, the term of this patent is extended or adjusted under 35 U.S.C. 154(b) by 390 days.

(21) Appl. No.: 16/212,385

(22) Filed: Dec. 6, 2018

(65) Prior Publication Data

US 2019/0176301 A1 Jun. 13, 2019

(30) Foreign Application Priority Data

Dec. 7, 2017 (TW) ..... 106143018

(51) Int. Cl.
*B25B 13/46* (2006.01)

(52) U.S. Cl.
CPC ..... *B25B 13/465* (2013.01)

(58) Field of Classification Search
CPC ..... B25B 13/465
USPC ..... 81/62
See application file for complete search history.

(56) References Cited

U.S. PATENT DOCUMENTS 2,836,273 A * 5/1958 Odlum ..... B25B 13/465 192/43.1
2011/0079114 A1* 4/2011 Chen ..... B25B 13/465 81/63

FOREIGN PATENT DOCUMENTS

TW M 350441 2/2009

* cited by examiner

*Primary Examiner* — Orlando E Aviles
*Assistant Examiner* — Donna Maynard
(74) *Attorney, Agent, or Firm* — Muncy, Geissler, Olds & Lowe, P.C.

(57) ABSTRACT

A ratchet wrench is provided, including a main body, a driving member, a ratchet assembly and a switch button. The main body has a receiving chamber, and a circumferential wall of the receiving chamber has an interior circumferential toothed portion. The driving member is disposed within the receiving chamber and rotatable about an axial direction. The ratchet assembly includes a first ratchet member and a second ratchet member which are swingably arranged in the driving member. The switch button is pivoted to the driving member, extends along a direction lateral to the axial direction and is swingable to be on a first position and a second position.

6 Claims, 7 Drawing Sheets

RATCHET WRENCH

BACKGROUND OF THE INVENTION

Field of the Invention

The present invention relates to a ratchet wrench.

Description of the Prior Art

Generally, when conducting a locking operation, in order to quickly lock objects, an operator uses a ratchet wrench which has a racing function to lock the objects, so the operator needs to swing the ratchet wrench back and forth to lock or unlock the locking member. In the conventional ratchet wrench, a main body mainly has an interior circumferential toothed portion, a driving member, a ratchet block and a rotation button, the rotation button is rotatably disposed in the driving member, the rotation button and the ratchet block has a spring therebetween so that the ratchet block normally abuts against the interior circumferential toothed portion to restrict a rotating direction of the driving member to make the driving member have an unidirectional racing function. The operator can rotate the rotation button to control swinging of the ratchet block so as to change a racing direction of the driving member. This type of ratchet wrench is disclosed in TWM350441.

However, when adjusting the switch button of the conventional ratchet wrench, the operator needs to hold the main body with one hand and the switch button with the other hand to make the main body and the switch button rotate relative to each other to change the racing direction. Therefore, it is inconvenient that if the operator has something on his/her hands, s/he has to put the things on both hands down first so as to change the racing direction.

The present invention has arisen to mitigate and/or obviate the afore-described disadvantages.

SUMMARY OF THE INVENTION

The major object of the present invention is to provide a ratchet wrench, which an operator can operate with one hand to change a racing direction, the ratchet wrench has a simple structure and low manufacture cost, and the ratchet wrench is easy to be operated and durable.

To achieve the above and other objects, a ratchet wrench is provided, including a main body, a driving member, a ratchet assembly and a switch button. The main body has a receiving chamber, and a circumferential wall of the receiving chamber has an interior circumferential toothed portion. The driving member is disposed within the receiving chamber and rotatable about an axial direction. The ratchet assembly includes a first ratchet member and a second ratchet member which are swingably arranged in the driving member. At least one first elastic member is arranged in the driving member and normally abuts against the first ratchet member and the second ratchet member to allow the first ratchet member and the second ratchet member to normally mesh with the interior circumferential toothed portion. The switch button is pivoted to the driving member, extends in a direction lateral to the axial direction and swingable to be on a first position and a second position, two ends of the switch button respectively have a first pressing portion and a second pressing portion, the first pressing portion has a first abutting member which is protrudingly disposed thereon, and the second pressing portion has a second abutting member which is protrudingly disposed thereon.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
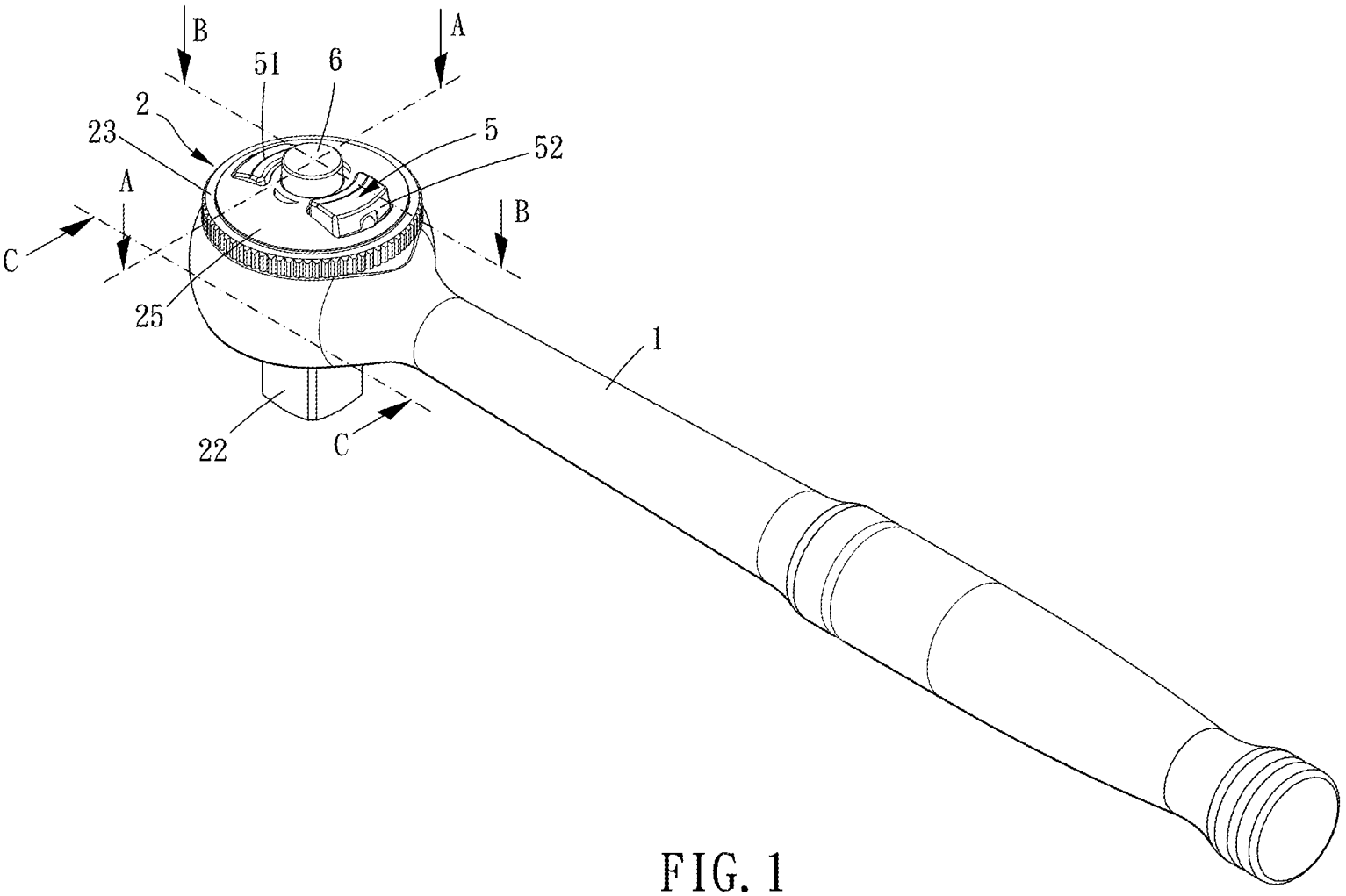
FIG. 1 is a stereogram of a preferred embodiment of the present invention.
Figure 3:
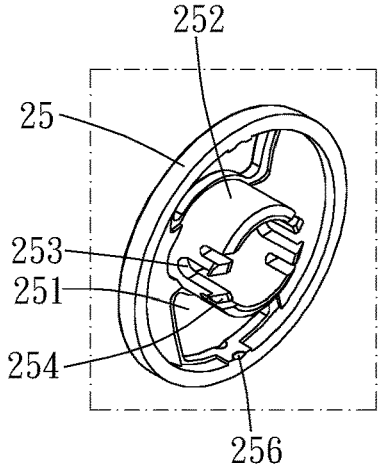
FIG. 3 is a partially breakdown view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 8 for a preferred embodiment of the present invention. A ratchet wrench includes a main body 1, a driving member 2, a ratchet assembly 3 and a switch button 5.

The main body 1 has a receiving chamber 11, and a circumferential wall of the receiving chamber 11 has an interior circumferential toothed portion 12.

Figure 2:
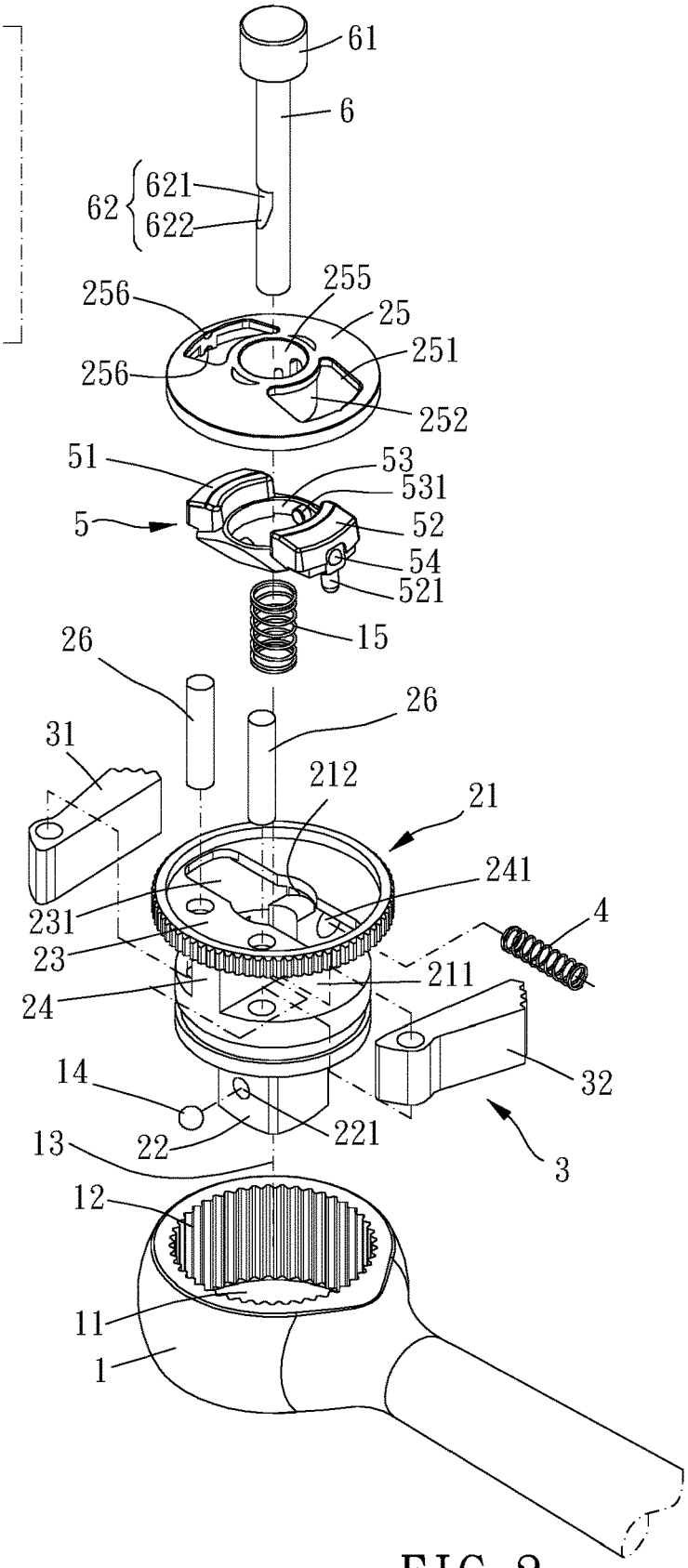
FIG. 2 is breakdown view of the preferred embodiment of the present invention.
Figure 4:
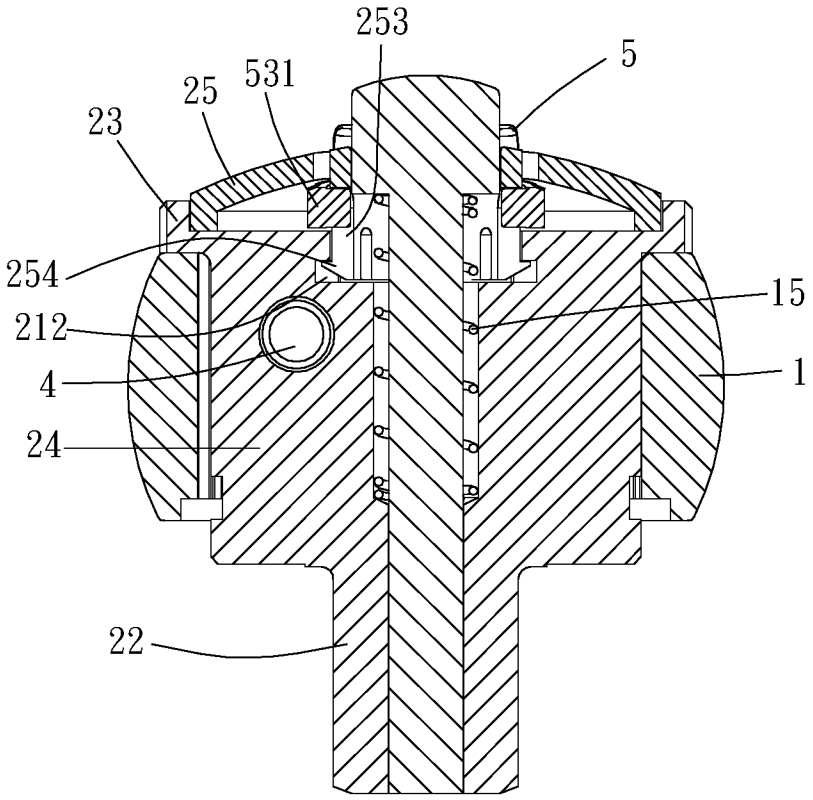
FIG. 4 is a cross-sectional view, taken along line A-A of FIG. 1.

The driving member 2 is disposed within the receiving chamber 11 and rotatable about an axial direction 13 (as shown in FIG. 2).

The ratchet assembly 3 includes a first ratchet member 31 and a second ratchet member 32 which are swingably arranged in the driving member 2.

At least one first elastic member 4 is arranged in the driving member 2 and normally abuts against the first ratchet member 31 and the second ratchet member 32, and the first ratchet member 31 and the second ratchet member 32 are normally meshed with the interior circumferential toothed portion 12.

The switch button 5 is pivoted to the driving member 2, extends in a direction lateral to the axial direction 13 and swingable to be on a first position and a second position, two ends of the switch button 5 respectively have a first pressing portion 51 and a second pressing portion 52, the first pressing portion 51 has a first abutting member 511 which is protrudingly disposed thereon, and the second pressing portion 52 has a second abutting member 521 which is protrudingly disposed thereon.

Figure 5:
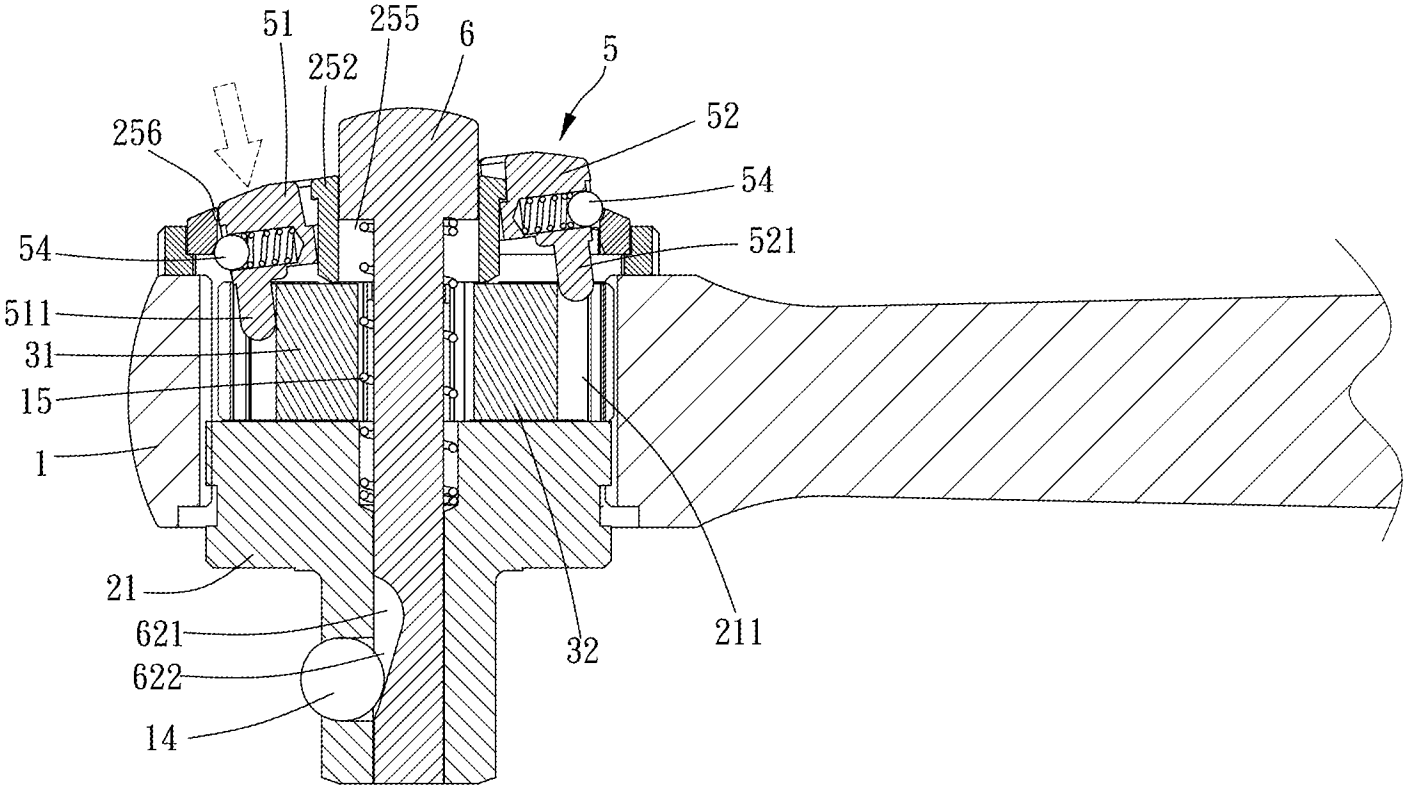
FIG. 5 is a cross-sectional view, taken along line B-B of FIG. 1.
Figure 6:
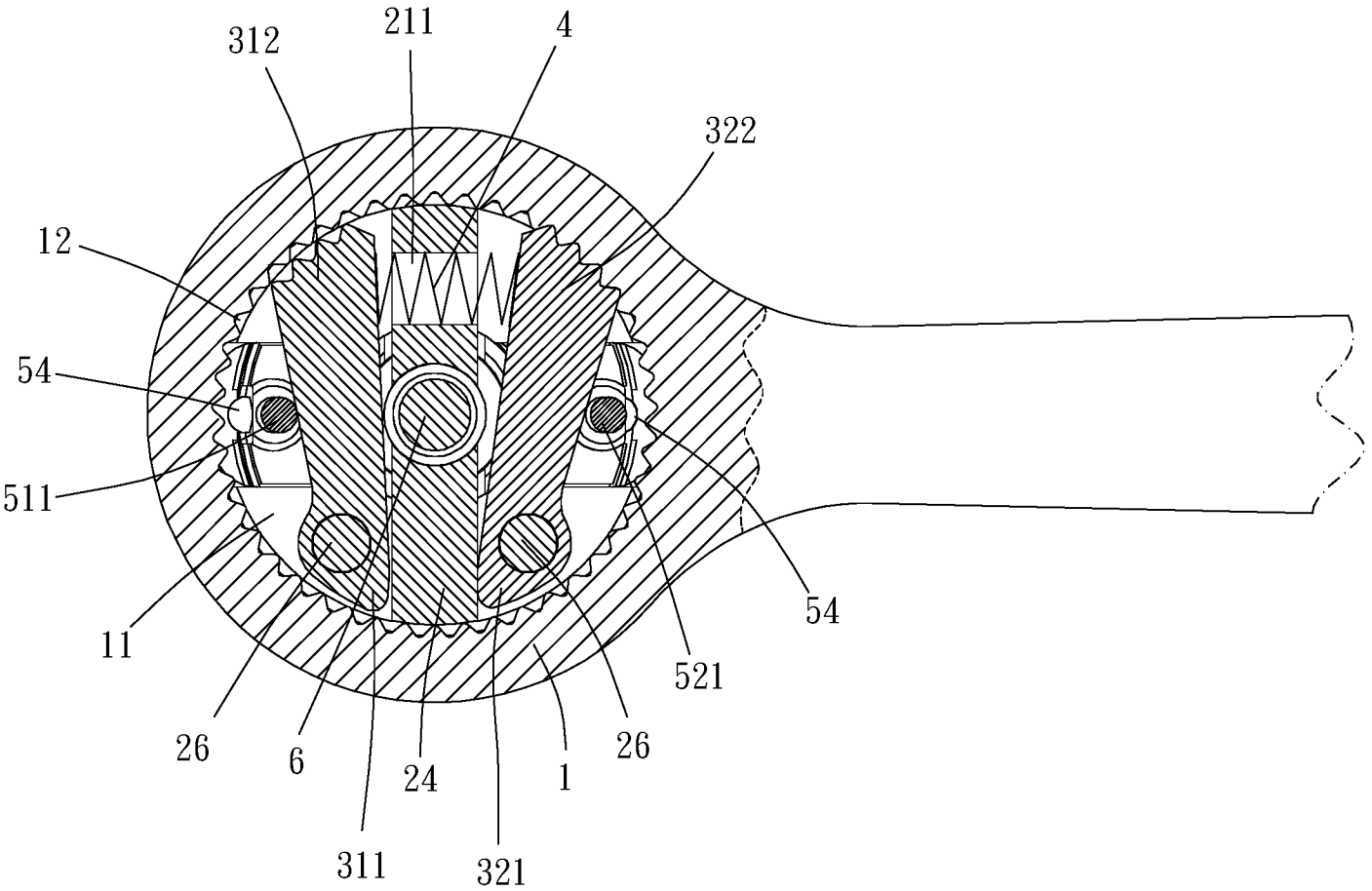
FIG. 6 is a cross-sectional view, taken along line C-C of FIG. 1.
Figure 7:
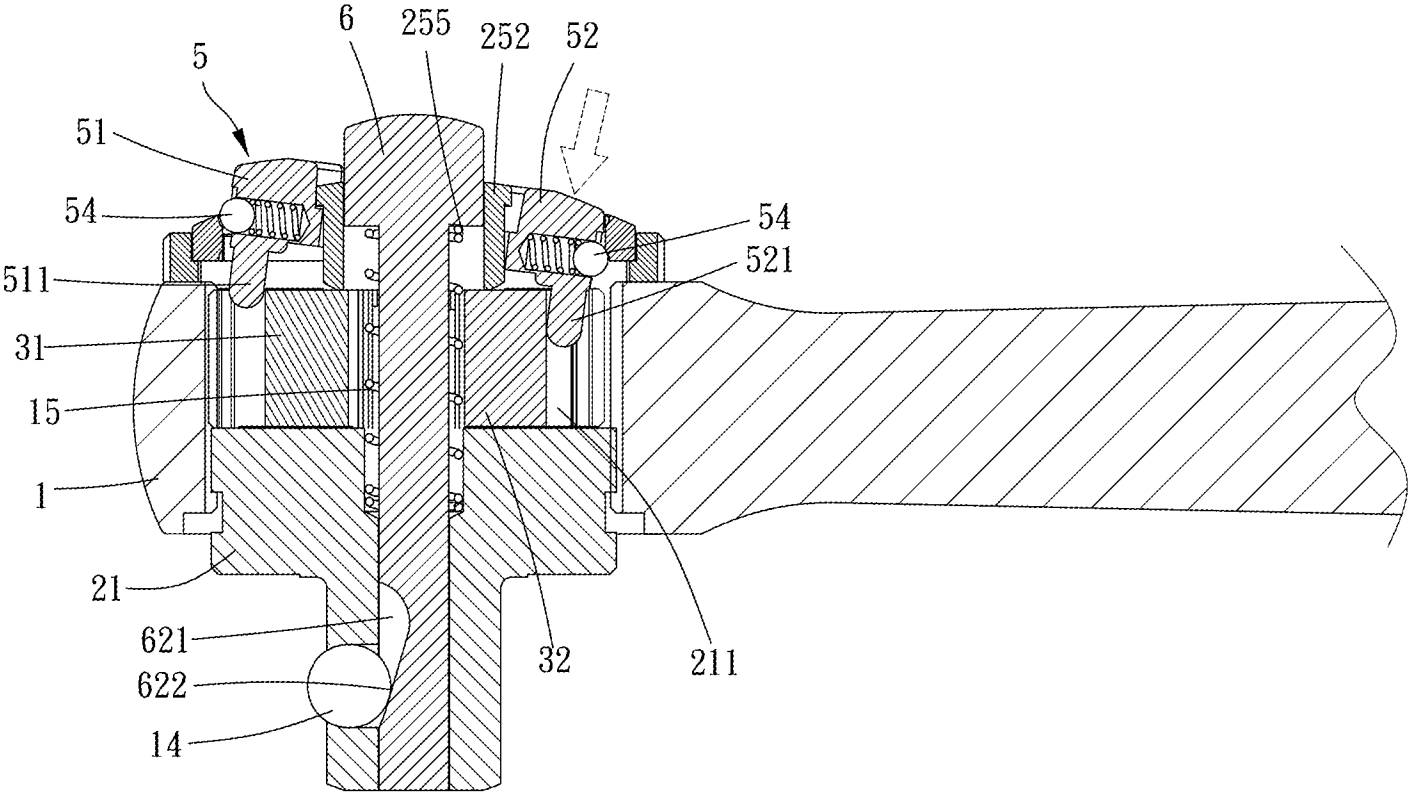
FIG. 7 is another cross-sectional view, taken along line A-A of FIG. 1.

When the switch button 5 swings to be on the first position (as shown in FIGS. 5 and 6), the first pressing portion 51 swings toward the receiving chamber 11, the second pressing portion 52 swings away from the receiving chamber 11, and the first abutting member 511 abuts against the first ratchet member 31, so that the first ratchet member 31 is non-meshed with the interior circumferential toothed portion 12, and the driving member 2 only rotates in a first rotation direction relative to the main body 1; when the switch button 5 swings to be on the second position (as shown in FIG. 7), the second pressing portion 52 swings toward the receiving chamber 11, the first pressing portion 51 swings away from the receiving chamber 11, and the second abutting member 521 abuts against the second ratchet member 32, so that the second ratchet member 32 is non-meshed with the interior circumferential toothed portion 12, and the driving member 2 can only rotates in a second rotation direction relative to the main body 1. Therefore, a user can hold the main body 1 with one hand and press the first pressing portion 51 or the second pressing portion 52, so that the user can change a racing direction with just one hand.

Specifically, one of two ends 311, 312 of the first ratchet member 31 and one of two ends 321, 322 of the second ratchet member 32 are respectively pivoted to the driving member 2 by pins 26, and the other of the two ends 311, 312 of the first ratchet member 31 and the other of the two ends 321, 322 of the second ratchet member 32 are free ends which are swingable, either of the free ends of the first and second ratchet members 31, 32 is meshable with the interior circumferential toothed portion 12, when the switch button 5 is on the first position, the first abutting member 511 abuts against a side of the first ratchet member 31 which is remote from the second ratchet member 32 to allow the free end of the first ratchet member 31 to swing toward the second ratchet member 32, and the first ratchet member 31 is non-meshed with the interior circumferential toothed portion 12; when the switch button 5 is on the second position, the second abutting member 521 abuts against a side of the second ratchet member 32 which is remote from the first ratchet member 31 to allow the free end of the second ratchet member 32 to swing toward the first ratchet member 31, and the second ratchet member 32 is non-meshed with the interior circumferential toothed portion 12. Through pressing the switch button 5 to swing, the first abutting member 511 and the second abutting member 521 can be controlled to bias exterior sides of the first ratchet member 31 and the second ratchet member 32 inwards so as to effectively ensure that there is only one of the first ratchet member 31 or the second ratchet member 32 meshed with the interior circumferential toothed portion 12 at the same time to allow the ratchet wrench to race unidirectionally.

Specifically, the driving member 2 includes a rotatable member 21, the rotatable member 21 has a receiving space 211, and the first and second ratchet members 31, 32 are pivotally arranged in the receiving space 211. In this embodiment, the rotatable member 21 includes a working portion 22, a top portion 23 and a connecting portion 24, the connecting portion 24 is connected to and between the top portion 23 and the working portion 22 to make the top portion 23 and the working portion 22 to be in a fixed co-moving relation, the top portion 23 and the working portion 22 define the receiving space 211 therebetween, the top portion 23 has a groove 231 which communicates with the receiving space 211, and the switch button 5 is arranged in the groove 231 to provide a space for the switch button 5 to swing.

In this embodiment, the first ratchet member 31 and the second ratchet member 32 are located by two sides of the connecting portion 24, the connecting portion 24 has a through hole 241, the first elastic member 4 is disposed through the through hole 241, and two ends of the first elastic member 4 respectively abut against the first ratchet member 31 and the second ratchet member 32. In other embodiments, the connecting portion 24 may not have the through hole 24, a number of the at least one elastic member may be two, one of the two first elastic members 4 abuts against the connecting portion 24 and the first ratchet member 31, and the other of the two first elastic members 4 abuts against the connecting portion 24 and the second ratchet member 32.

Preferably, the driving member 2 includes a cover member 25, the cover member 25 covers the rotatable member 21, the switch button 5 is positioningly restricted between the rotatable member 21 and the cover member 25, the ratchet assembly 3 is swingably arranged within the rotatable member 21, and the cover member 25 has two window holes 251 which respectively respond to the first pressing portion 51 and the second pressing portion 52, so that it is convenient to press the first and second pressing portions 51, 52.

It is to be noted that one of two ends of the first pressing portion 51 remote from the second pressing portion 52 and one of two ends of the second pressing portion 52 remote from the first pressing portion 51 respectively have a biasing member 54 radially arranged, each of the two window holes 251 has a curved notch 256 recessed axially on a side thereof which is located radially away from the axial direction 13, and each of the two biasing members 54 biases one of said curved notch 256. Through the two biasing members 54 respectively and optionally abut against one of the two curved notches 256, the switch button 5 can be prevented from swinging randomly and from causing the ratchet wrench to race in another direction randomly.

In this embodiment, the cover member 25 has an annular wall 252 which protrudes toward the rotatable member 21, the annular wall 252 is inserted into the rotatable member 21, the switch button 5 has an annular sleeve portion 53, the first pressing portion 51 and the second pressing portion 52 are integrally formed on two ends of the annular sleeve portion 53, the annular sleeve portion 53 is sleeved on the annular wall 252, one of the annular wall 252 and the annular sleeve portion 53 includes at least one pivotal hole 253, and the other of the annular wall 252 and the annular sleeve portion 53 includes at least one protrusive shaft 531 which is inserted into the at least one pivotal hole 253 to allow the switch button 5 to swing relative to the cover member 25. In this embodiment, the annular wall 252 has the two pivotal holes 253, the annular sleeve portion 53 has the two protrusive shafts 531; in other embodiments, the annular sleeve portion may have the two pivotal holes 253, and the annular wall may have the two protrusive shafts 531.

Preferably, the annular wall 252 has at least one hook portion 254 which is arranged radially outwards, the rotatable member 21 has at least one notch 212, and when the annular wall 252 is inserted into the rotatable member 21, the at least one hook portion 254 hooks on the at least one notch 212 to prevent the cover member 25 from detached from the rotatable member 21.

Figure 8:
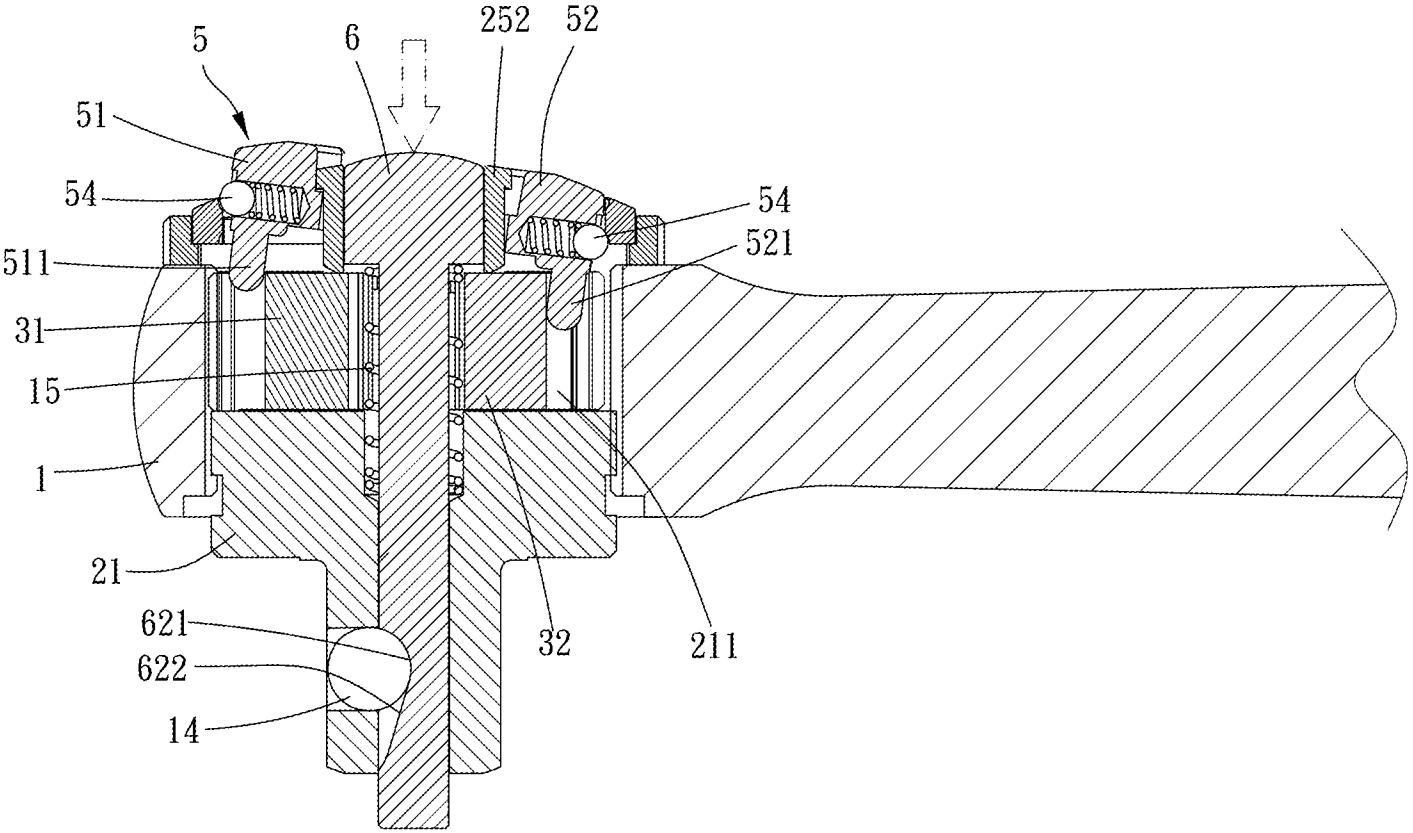
FIG. 8 is an operation view of FIG. 7.

Specifically, in this embodiment, the ratchet wrench further includes a pressing lever 6, the cover member 25 has an open hole 255, the annular wall 252 integrally extends from an hole edge of the open hole 255, the pressing lever 6 is slidably disposed, along the axial direction 13, through the open hole 255 of the cover member 25, the annular sleeve portion 53 of the switch button 5 and the working portion 22 of the rotatable member 21, the pressing lever 6 is slidable to be on a locking position and release position, one of two ends of the pressing lever 6 remote from the working portion 22 has a head portion 61 which has a greater dimension, the pressing lever 6 has a recessed portion 62 radially arranged, the recessed portion 62 includes a deeper stepped portion 621 and a shallower stepped portion 622, the working portion 22 radially has a receiving hole 221 which communicates with an interior of the working portion 22, a restriction ball 14 is slidably arranged within the receiving hole 221, a second elastic member 15 abuts against and between the head portion 61 of the pressing lever 6 and the working portion 22 so that the pressing lever 6 is normally biased toward the locking position, when the pressing lever 6 is on the locking position (as shown in FIG. 7), the shallower stepped portion 622 corresponds to the receiving hole 221, the restriction ball 14 is engaged with the shallower stepped portion 622 and partly protrudes beyond the working portion 22, the restriction ball 14 is engaged with the shallower stepped portion 622 to prevent the pressing lever 6 from being detached from the working portion 22, the restriction ball 14 protrudes beyond the working portion 22 to be engaged with a socket tool (not shown) to allow the working portion 22 to stably inserted into the socket tool and will not fall off randomly; when the pressing lever 6 moves to the release position (as shown in FIG. 8), the deeper stepped portion 621 corresponds to the receiving hole 221, the restriction ball 14 is movable toward the deeper stepped portion 621, and the restriction ball 14 is entirely nonprotrusive beyond the working portion 22 to allow the working portion 22 to be smoothly assembled to or disassembled from the socket tool.

Given the above, in the ratchet wrench, the first pressing portion or the second pressing portion swings toward the receiving chamber, and the user can hold the main body with one hand and press the first pressing portion or the second pressing portion, so that the user can change the racing direction with just one hand.

While we have shown and described various embodiments in accordance with the present invention, it should be clear to those skilled in the art that further embodiments may be made without departing from the scope of the present invention.

What is claimed is:

1. A ratchet wrench, including:

a main body, having a receiving chamber, a circumferential wall of the receiving chamber having an interior circumferential toothed portion;

a driving member, disposed within the receiving chamber and rotatable about an axial direction;

a ratchet assembly, including a first ratchet member and a second ratchet member which are swingably arranged in the driving member;

at least one first elastic member, arranged in the driving member and abutting against the first ratchet member and the second ratchet member to allow the first ratchet member and the second ratchet member to mesh with the interior circumferential toothed portion;

a switch button, pivoted to the driving member, extending in a direction lateral to the axial direction and swingable to be on a first position and a second position, two ends of the switch button respectively having a first pressing portion and a second pressing portion, the first pressing portion having a first abutting member which is protrudingly disposed thereon, the second pressing portion having a second abutting member which is protrudingly disposed thereon;

wherein when the switch button swings to be on the first position, the first pressing portion swings toward the receiving chamber, the second pressing portion swings away from the receiving chamber, and the first abutting member abuts against the first ratchet member, so that the first ratchet member is non-meshed with the interior circumferential toothed portion; when the switch button swings to be on the second position, the second pressing portion swings toward the receiving chamber, the first pressing portion swings away from the receiving chamber, and the second abutting member abuts against the second ratchet member, so that the second ratchet member is non-meshed with the interior circumferential toothed portion;

wherein one of two ends of the first ratchet member and one of two ends of the second ratchet member are respectively pivoted to the driving member by pins, and the other of the two ends of the first ratchet member and the other of the two ends of the second ratchet member are free ends which are swingable, either of the free ends of the first and second ratchet members is meshable with the interior circumferential toothed portion;

when the switch button is on the first position, the first abutting member abuts against a side of the first ratchet member which is remote from the second ratchet member, to allow the free end of the first ratchet member to swing toward the second ratchet member; when the switch button is on the second position, the second abutting member abuts against a side of the second ratchet member which is remote from the first ratchet member, to allow the free end of the second ratchet member to swing toward the first ratchet member;

wherein the driving member includes a rotatable member, the rotatable member has a receiving space, and the first and second ratchet members are pivotally arranged in the receiving space;

wherein the rotatable member includes a working portion, a top portion and a connecting portion, the connecting portion is connected to and between the top portion and the working portion, the top portion and the working portion define the receiving space therebetween, the top portion has a groove which communicates with the receiving space, and the switch button is arranged in the groove;

wherein the first ratchet member and the second ratchet member are located by two sides of the connecting portion, the connecting portion has a through hole, the first elastic member is disposed through the through hole, and two ends of the first elastic member respectively abut against the first ratchet member and the second ratchet member.

2. The ratchet wrench of claim 1, wherein the driving member includes a cover member, the cover member covers the rotatable member, the switch button is positioningly restricted between the rotatable member and the cover member, the ratchet assembly is swingably arranged within the rotatable member, and the cover member has two window holes which respectively respond to the first pressing portion and the second pressing portion.

3. The ratchet wrench of claim 2, wherein one of two ends of the first pressing portion remote from the second pressing portion and one of two ends of the second pressing portion remote from the first pressing portion respectively have a biasing member radially arranged, each of the two window holes has a curved notch recessed axially on a side thereof which is located radially away from the axial direction, and each of the two biasing members biases one of said curved notch.

4. The ratchet wrench of claim 2, wherein the cover member has an annular wall which protrudes toward the rotatable member, the annular wall is inserted into the rotatable member, the switch button has an annular sleeve portion, the first pressing portion and the second pressing portion are integrally formed on two ends of the annular sleeve portion, the annular sleeve portion is sleeved on the annular wall, one of the annular wall and the annular sleeve portion includes at least one pivotal hole, and the other of the annular wall and the annular sleeve portion includes at least one protrusive shaft which is inserted into the at least one pivotal hole.

5. The ratchet wrench of claim 4, wherein the annular wall has at least one hook portion which is arranged radially outwards, the rotatable member has at least one notch, and when the annular wall is inserted into the rotatable member, the at least one hook portion hooks on the at least one notch.

6. The ratchet wrench of claim 4, further including a pressing lever, the cover member has an open hole, the annular wall integrally extending from a hole edge of the open hole, the pressing lever slidably disposed, along the axial direction, through the open hole of the cover member, the annular sleeve portion of the switch button and the working portion of the rotatable member, the pressing lever being slidable to be on a locking position and release position, one of two ends of the pressing lever remote from the working portion having a head portion which has a greater dimension, the pressing lever having a recessed portion radially arranged, the recessed portion including a deeper stepped portion and a shallower stepped portion, the working portion radially having a receiving hole which communicates with an interior of the working portion, a restriction ball being slidably arranged within the receiving hole, a second elastic member abutting against and between the head portion of the pressing lever and the working portion so that the pressing lever is in a normal rest state biased toward the locking position, when the pressing lever is on the locking position, the shallower stepped portion corresponding to the receiving hole, the restriction ball is engaged within the shallower stepped portion and partly protrudes beyond the working portion, when the pressing lever moves to the release position, the deeper stepped portion corresponds to the receiving hole, the restriction ball is movable toward the deeper stepped portion, and the restriction ball is entirely within the working portion and nonprotrusive beyond the working portion.

* * * * *